United States Patent [19]

Stone

[11] 4,261,469

[45] Apr. 14, 1981

[54] CLOTHESLINES

[76] Inventor: Frederick K. Stone, 30 Gorman St., Macandrew Bay, Dunedin, New Zealand

[21] Appl. No.: 23,628

[22] Filed: Mar. 26, 1979

[30] Foreign Application Priority Data

Apr. 28, 1978 [NZ] New Zealand ..... 187111

[51] Int. Cl.[3] ..... D86F 53/00

[52] U.S. Cl. ..... 211/119.1

[58] Field of Search ..... 211/119.01, 119.02, 211/119.03, 119.09, 119.1, 119.15, 119.16, 189, 196, 197; 248/407, 408; 403/300, 301, 314

[56] References Cited

U.S. PATENT DOCUMENTS

| | | | |
|---|---|---|---|
| 566,809 | 9/1896 | Strong | 248/407 X |
| 840,267 | 1/1907 | Stebbins | 211/119.15 X |
| 985,485 | 2/1911 | Willard | 211/119.1 |
| 1,073,230 | 9/1913 | Gould | 211/119.15 X |
| 2,289,725 | 7/1942 | Orton | 211/119.15 |
| 2,293,251 | 8/1942 | Fords | 211/119.1 |
| 2,467,814 | 4/1949 | Cox | 211/119.15 |
| 2,499,123 | 2/1950 | White | 211/119.15 X |
| 2,896,792 | 7/1959 | Bodine | 211/119.15 |
| 2,950,823 | 8/1960 | Woidka . | |
| 3,675,785 | 7/1972 | Martin | 211/119.1 |

FOREIGN PATENT DOCUMENTS

| | | | |
|---|---|---|---|
| 1269119 | 7/1961 | France | 211/119.1 |
| 596125 | 7/1959 | Italy | 211/119.02 |
| 286084 | 10/1952 | Switzerland | 211/119.1 |

*Primary Examiner*—Thomas J. Holko

[57] ABSTRACT

There is disclosed a clothesline which comprises two supports adapted to be mounted in a spaced apart relationship and at least one pair of arms which can each be connected to an individual one of the supports, for example by insertion in a socket of the support. The arms of each pair are interconnected by one or more resilient cords which tend to pull the arms together so they lock in position in the sockets the cords at the same time serving for the hanging of laundry. The capacity of the clothesline can be increased by insertion of one or more additional pairs of such arms in corresponding sockets of the supports.

10 Claims, 2 Drawing Figures

CLOTHESLINES

BACKGROUND OF THE INVENTION

The present invention relates to a clothesline, and has particular reference to a clothesline that can be disassembled and stored when not in use.

In many circumstances, for reasons of space or aesthetics, it is inappropriate to install a clothesline that forms a permanent fixture and instead provision is made for erection of a clothesline that can, after use, be disassembled and stored. Such a clothesline should desirably be of sturdy construction so as to withstand the weight of laundry and yet sufficiently light and simple to facilitate assembly. The assembled components should be interlocked to resist separation during the application of laundry to the clothesline, while the interlocking should be capable of being effected with the minimum complication.

OBJECTS OF THE INVENTION

The present invention therefore has as its main object the provision of a clothesline which is relatively simple to assemble and disassemble, forms a sturdy construction when assembled, and the principal components of which can be interlocked and released merely by the actions of assembly and disassembly.

Other objects and advantages of the invention will be apparent from the following description.

SUMMARY OF THE INVENTION

According to the present invention, therefore, there is provided a clothesline comprising two support means adapted to be mounted in spaced relationship, at least one pair of arms which are connectible to, respectively, the two support means, and at least one resilient cord so interconnecting the arms of said at least one pair as to bias the arms, when connected to the support means, into locking engagement with the support means.

In a basic form of the invention, the support means of the clothesline can be mounted on a wall surface or one one or more other suitable support surfaces, with the two arms connected to the support means so as to project from the surface or surfaces and with a single resilient cord extending between the arms for the suspension of laundry or other articles to be aired or dried. The spacing of the arms in relation to the length of the cord is such that the cord is caused to resiliently draw the arms towards each other and into a locked position relative to the support means, while by moving the arms apart to relieve the bias applied by the cord, the arms can be unlocked from the support means. The support means may remain in place while the arms are removed and stored, so as to restore to the user the space formerly occupied by the assembled clothesline.

In a development of the invention, the clothesline includes two such pairs of arms, the arms of each pair being connectible to the support means to extend away from the support means in a direction generally opposite to that of the arms of the other pair. Such an arrangement substantially increases the capacity of the clothesline in relation to the simpler form described in the preceding paragraph, and is generally suitable in circumstances where the support means can be mounted on, for example, two separate support surfaces, such as two facing walls or posts, or a post and a wall.

Whilst the arms and support means may be interlocked simply through the pressure exerted by the resilient cord or cords, for preference the support means said arms also comprise detent means co-operable under the action of the resilient cord or cords to provide positive location of the arms relative to to the support means when the arms are connected thereto. Such detent means ensures positive interlocking of the components and enhances resistance to or otherwise completely prevents any undesired tendency for the assembled components to displace relative to each other and possibly separate.

In one convenient arrangement, such detent means comprises a recess provided in each of the arms and corresponding projections provided on the support means for engagement in the recesses, each recess consisting of, for example, a notch or dimple and each projection of a moulded or deformed portion of the support means. As will be apparent, the detent means may equally well comprise a projection provided on each of the arms and corresponding recesses in the support means for engagement therein of the projections.

Many suitable constructions of the support means and arms are possible, but in a preferred arrangement each of the support means is provided with a respective socket for engagement therein of the or each arm connectible to that support means. In this case, each of the support means conveniently comprises a tubular member and the or each socket of that support means is provided by a length portion of the tubular member. In this arrangement, the arms are a simple sliding fit in the tubular members forming the support means, the material cost and constructional requirements of components of this kind being relatively low.

In an alternative arrangement, which is the reverse of that just described, each of the arms comprises a socket and each of the support means comprises a respective insert portion for engagement in the socket of the or each arm connectible to that support means. The support means preferably also each comprise at least one mounting bracket for mounting of the support means to a support surface.

The interlocking of the support means and arms and provision of line for the hanging of laundry may be satisfied by the presence of a single resilient cord between the arms of the or each pair, but to increase the interlocking effect and the load capacity of the clothesline the arms of the or each pair are preferably interconnected by a plurality of such resilient cords, the cords of the or each plurality extending substantially parallel to each other and being arranged in a spaced apart relationship.

BRIEF DESCRIPTION OF THE DRAWINGS

An embodiment of the present invention will now be more particularly described by way of example with reference to the accompanying drawings, in which.

DESCRIPTION OF THE PREFERRED EMBODIMENT

Figure 1:
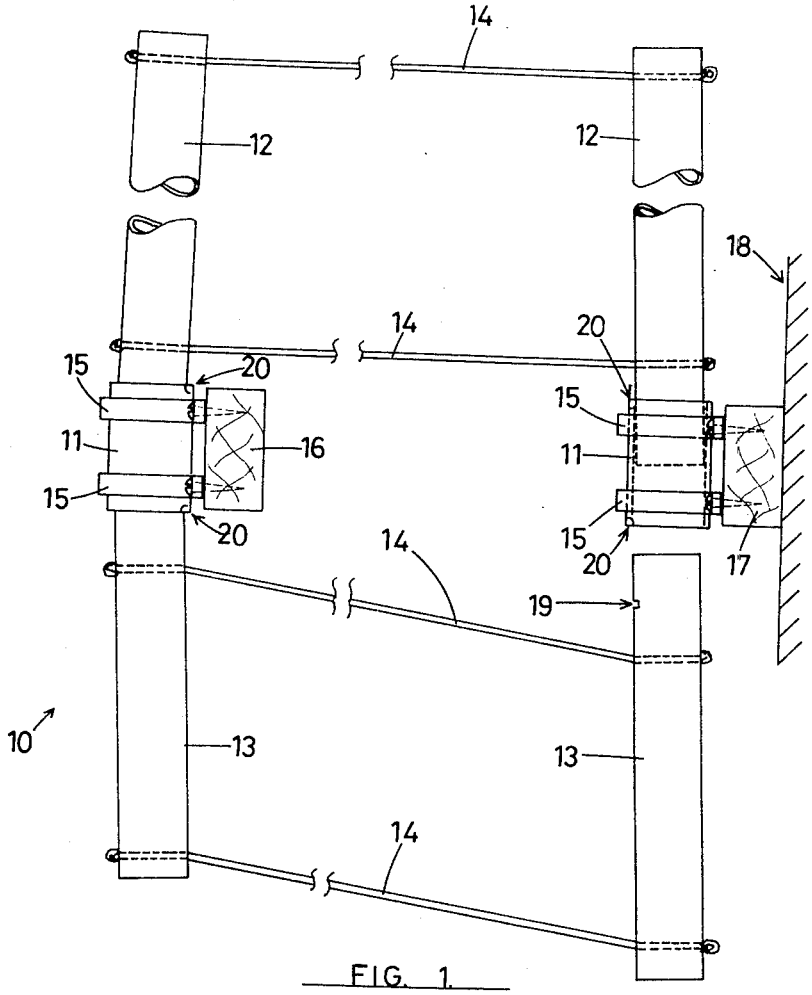
FIG. 1 is a plan view of an almost completely assembled clothesline embodying the invention.

Referring now to the drawings, there is shown a clothesline, indicated generally at 10, essentially comprising two tubular support members 11, a first pair of tubular arms 12 and a second pair of tubular arms 13, the arms of each pair being interconnected by a respective pair of parallel, spaced apart elastic ropes 14 which serve both to resiliently lock the arms 12 and 13 to the support members 11 and to provide line for the hanging of laundry. The support members and arms are made of aluminium or other light but rigid and durable material.

Figure 2:
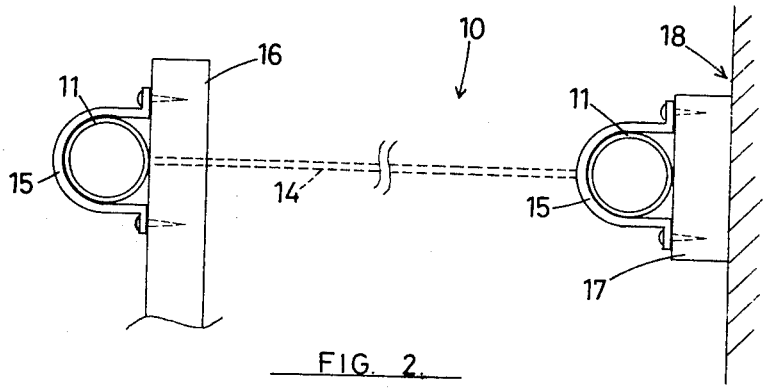
FIG. 2 is a side view of the clothesline of FIG. 1 but with the arms removed.

Each of the tubular support members 11 is mounted by a pair of spaced clamps 15 to a respective vertical support surface, in the one case a post 16 and in the other case a spacer block 17 secured to a wall surface 18. The support members 11 are mounted at a suitable spacing from each other, generally commensurate with the length of line desired therebetween for the hanging of laundry, and are arranged so that their axes are parallel and substantially horizontal, as can be seen from FIG. 2. The exact orientation of the support members in a particular case may depend, however, on the level of the ground above which they are mounted, as inclined ground may dictate a correspondingly inclined orientation.

Each of the tubular arms 12 and 13 has, as illustrated in FIG. 1, an end portion slidably engageable in a respective end or sleeve portion of a respective one of the tubular support members 11, the arrangement being such that when fitted to the support members the two pairs of arms 12 and 13 extend away from each other in generally opposite directions. The two elastic ropes 14 interconnecting the arms of each pair are disposed in the proximity of the ends of the arms so that there is sufficient working space between the ropes for appendage of laundry thereto and to allow adequate separation of the laundry when suspended from the ropes. The ropes 14 extend through corresponding transverse openings in the arms and are knotted at their ends at the remote sides of the arms so that the arms cannot be removed from the ropes.

In the assembled state of the clothesline 10, the arms 12 and 13 are drawn by the elastic ropes 14 into locking engagement with the interior walls of the support members 11, to which end either the distance between the support members 11 in their respective stations is chosen to be greater than the length of the ropes 14 or else—when the support members 11 are mounted at a desired or possibly obligatory spacing—the length of each rope 14 is adjusted to be less than this spacing by shortening the rope and retying one of its securing knots. The external diameter of each of the arms 12 and 13 is slightly less than the internal diameter of each tubular support member 11, so that when the arms are inserted in the end portions of the support members and are drawn towards each other by the ropes 14, there results a slight inclination of the axis of each arm relative to the axis of the support member to which it is connected.

To ensure positive retention of each arm in its respective support member, the arms and support members are provided with co-operable detent means. In the illustrated embodiment the detent means takes the form of recesses 19 (only one of which is shown in the drawings) in the walls of the arms and corresponding projections 20 on the interior walls of the support members 11, the projections preferably being formed by deforming the walls of the support members and the recesses by providing a notch, dimple, bore or the like in the arms. The projections may equally well be provided by moulding or forging, or by an additional element such as a rivet. When the arms are in place in the support members, the projections 20 are automatically engaged in their respective recesses 19 and retained therein by the tension of the ropes 14, so as to securely and positively locate the arms in the support members. However, the aforesaid difference between the external diameters of the arms 12 and 13 and the internal diameters of the support members 11 is sufficient to permit movement of the former into and out of the latter without interference by the detent means provided, of course, the bias of the ropes 14 is counteracted.

To release the arms from the support members, either one of the arms of each pair is moved counter to the pull of the elastic ropes 14 until the associated projection 20 is disengaged from its recess 19 and the arm can be freely withdrawn from the support member. Removal of one arm of each pair enables release of the tension applied to the other arm of the pair, so that it in turn may be withdrawn. Assembly of the arms in the support members is carried out in the reverse sequence, assembly and disassembly thus requiring only simple actions on the part of the user.

As will be apparent, only one pair of the arms need be fitted to the support members if so desired, which thus realises a more basic form of the invention, and the pairs of arms are preferably of identical construction so as to be interchangeable from side to side. If so desired, however, or it it is convenient or necessary to do so, one pair of arms may differ from the other pair with respect to, for example, their lengths and the number of interconnecting elastic ropes.

The foregoing embodiment concerns a construction suitable for typical domestic requirements, wherein two pairs of arms extend in a generally common plane. However, as may be appropriate, only one pair of arms need be provided or additional pairs may be provided in any suitable arrangement. In the case of two pairs of arms, the pairs need not lie in a common plane but, in end view of the clothesline, the pairs may be inclined relative to each other. The arms of each pair may also be mounted so as to extend at an angle to each other, apart from any angle resulting from the pull of the elastic ropes, and the arms connected to the same support member may be inclined relative to each other in plan view of the clothesline. Other permutations of the number and arrangement of the arms will be readily apparent, as will be different constructions of the support members and methods of effecting connection of the arms thereto.

The clothesline hereinbefore described may be erected or taken down with relative ease and is particularly favourable for use in circumstances where a permanent installation is either inappropriate or not desired for aesthetic reasons.

What is claimed is:

1. A clothesline comprising two support means adapted to be mounted in spaced relationship, at least one pair of arms which are connectible to, respectively, said two support means, and at least one resilient cord interconnecting the arms of said at least one pair, said support means and arms comprising detent means cooperable under the action of said resilient cord or cords to provide positive location of said arms relative to said support means when said arms are connected thereto.

2. A clothesline according to claim 1, comprising two such pairs of arms, the arms of each pair being connectible to said support means to extend away from said support means in a direction generally opposite to that of the arms of the other pair.

3. A clothesline according to claim 1, wherein said detent means comprises a recess provided in each of said arms and corresponding projections provided on said support means for engagement in said recesses.

4. A clothesline according to claim 3, wherein said recesses are formed by notches in said arms and said projections by deformed portions of said support means.

5. A clothesline according to claim 1, wherein each of said support means comprises a respective socket for engagement therein of the or each said arm connectible to that support means.

6. A clothesline according to claim 5, wherein each of said support means comprises a tubular member and the or each said socket of that support means is provided by a length portion of said tubular member.

7. A clothesline according to claim 1, wherein each of said support means comprises at least one mounting bracket for mounting of said support means to a support surface.

8. A clothesline according to claim 1, wherein said arms consist of substantially cylindrical members.

9. A clothesline according to claim 1, comprising a plurality of such resilient cords interconnecting the arms of the or each said pair, the cords of the or each said plurality extending substantially parallel to each other and being arranged in a spaced apart relationship.

10. A clothesline according to claim 1, wherein said arms are provided with openings extending transversely therethrough and the or each said resilient cord is connected to said arms by being threaded through said openings and knotted at its ends.

* * * * *